US007203333B2

(12) United States Patent
Funahashi et al.

(10) Patent No.: US 7,203,333 B2
(45) Date of Patent: Apr. 10, 2007

(54) SPEAKER

(75) Inventors: Osamu Funahashi, Takatsuki (JP); Hiroyuki Morimoto, Mie (JP)

(73) Assignee: Matsushita Electric Industrial Co., Ltd. (JP)

( * ) Notice: Subject to any disclaimer, the term of this patent is extended or adjusted under 35 U.S.C. 154(b) by 155 days.

(21) Appl. No.: 10/519,425

(22) PCT Filed: Mar. 29, 2004

(86) PCT No.: PCT/JP2004/004393

§ 371 (c)(1),
(2), (4) Date: Dec. 21, 2004

(87) PCT Pub. No.: WO2004/089037

PCT Pub. Date: Oct. 14, 2004

(65) Prior Publication Data

US 2005/0201588 A1 Sep. 15, 2005

(30) Foreign Application Priority Data

Mar. 31, 2003 (JP) ..... 2003-094935

(51) Int. Cl.
*H04R 25/00* (2006.01)

(52) U.S. Cl. ..... 381/403; 381/424

(58) Field of Classification Search ..... 181/164, 181/165, 171, 172, 173; 381/184, 342, 398, 381/400, 403, 404, 407, 420, 423, 424, 432
See application file for complete search history.

(56) References Cited

U.S. PATENT DOCUMENTS 5,323,469 A * 6/1994 Scholz ..... 381/403
5,847,333 A * 12/1998 D'Hoogh ..... 181/171
6,095,280 A * 8/2000 Proni ..... 181/171
6,236,733 B1 * 5/2001 Kato et al. ..... 381/423
2002/0071592 A1 * 6/2002 Proni ..... 381/423
2003/0185415 A1 * 10/2003 Funahashi et al. ..... 381/398
2004/0076309 A1 * 4/2004 Sahyoun ..... 381/412
2004/0165746 A1 * 8/2004 Kreitmeier et al. ..... 381/398

FOREIGN PATENT DOCUMENTS

JP 3-99600 A 4/1991
JP 8-102993 A 4/1996

(Continued)

*Primary Examiner*—Sinh Tran
*Assistant Examiner*—Joseph Saunders, Jr.
(74) *Attorney, Agent, or Firm*—Rossi Kimms & McDowell LLP

(57) ABSTRACT

A speaker has a diaphragm (16) and a suspension holder (19) supporting the diaphragm from the back surface of the diaphragm. The diaphragm has a bent section (21) disposed between its outer periphery and its inner periphery, with the portion to the outer periphery having a conical shape. The diaphragm is coupled to the suspension holder at the bent section. This configuration can omit a damper that causes nonlinearity and asymmetry of suspension, to reduce the harmonic distortion of the speaker and improve the power linearity and the performance of the speaker. The diaphragm can have a flat configuration at its inner peripheral portion, can be secured with sufficient rigidity, and can be rigidly secured to a frame of the sneaker. This can reduce the thickness of the diaphragm and enable formation of a smaller, low profile sneaker can be realized.

27 Claims, 15 Drawing Sheets

FOREIGN PATENT DOCUMENTS

| | | | | |
|---|---|---|---|---|
| JP | 10042392 | A | * | 2/1998 |
| JP | 11-510033 | A | | 8/1999 |
| JP | 11-355883 | A | | 12/1999 |
| JP | 2000-69588 | A | | 3/2000 |
| JP | 2002-51394 | A | | 2/2002 |

* cited by examiner

SPEAKER

This application is a U.S. National Phase Application of PCT International Application PCT/JP02/07426.

TECHNICAL FIELD

The present invention relates to a speaker used for various audio apparatuses.

BACKGROUND ART

FIG. 24 shows a conventional speaker. The conventional speaker has the following elements:

magnetic circuit 1;

voice coil body 4 having coil section 3 movable in magnetic gap 2;

diaphragm 5 of which inner periphery is coupled to voice coil body 4 and outer periphery is coupled to frame 7 via edge 6; and damper 8 of which inner periphery is coupled to voice coil body 4 and outer periphery is coupled to frame 7.

In the conventional speaker, when an electric signal output from an audio amplifier or the like is fed into coil section 3, voice coil body 4 vibrates, the vibromotive force is transmitted to diaphragm 5, and diaphragm 5 vibrates air to convert the electric signal to voice. Damper 8 is combined with edge 6 to form a suspension to prevent voice coil body 4 from rolling. Damper 8 has a combined shape of a plurality of corrugations and is hence prevented from working as a movable load on voice coil body 4. Diaphragm 5 is made conical to secure rigidity thereof.

Since damper 8 has the combined shape of the plurality of corrugations in the speaker having this configuration, the movable load of damper 8 has high nonlinearity and high asymmetry between the behavior where diaphragm 5 moves toward magnetic circuit 1 and the behavior where diaphragm 5 moves in the direction opposite to magnetic circuit 1. This speaker therefore has problems related to the following items:

linearity of relation between an input signal of the speaker and displacement of amplitude of diaphragm 5;

symmetry in the vertical direction; and distortion and quality of sound.

Since diaphragm 5 is made conical to secure rigidity thereof, it is difficult to thin the speaker itself.

A speaker as one of measures for addressing the problems is disposed in Japanese Patent Unexamined Publication No. 2000-69588. In this speaker, as shown in FIG. 25, two curved dampers 8 are mounted mutually oppositely between voice coil body 4 and frame 7. It is described that using two dampers 8 cancels the nonlinearity of the relation between the input signal level and amplitude of diaphragm 5 and improves the distortion and quality of sound.

In the speaker having the conventional configuration, however, the improvement of the distortion and quality of the sound is not sufficiently effective and thinning of the speaker is difficult.

Using damper 8 causes the problems. The movable load of damper 8 has high nonlinearity and high asymmetry between the behavior where voice coil body 4 moves toward magnetic circuit 1 and the behavior where voice coil body 4 moves in the direction opposite to magnetic circuit 1, so that large harmonic distortion occurs and power linearity degrades. Diaphragm 5 is required to be thick for securing rigidity thereof, so that there is a limit to thin the speaker.

FIG. 26 shows power linearity of the conventional speaker of FIG. 24, namely relation between input power of the speaker and displacement of diaphragm 5. Curve A0 shows an amplitude characteristic of diaphragm 5 directed toward magnetic circuit 1, and curve B0 shows an amplitude characteristic of diaphragm 5 in the direction opposite to magnetic circuit 1. FIG. 27 shows a harmonic distortion characteristic of the conventional speaker, and shows that the larger the dynamic range of the output sound pressure and the harmonic distortion is, the lower the harmonic distortion is. Curve C0 shows an output sound pressure characteristic, curve D0 shows a second harmonic distortion characteristic, and curve E0 shows a third harmonic distortion characteristic.

For addressing the degradation of power linearity and the problem of the harmonic distortion characteristic caused by the nonlinearity and asymmetry, various proposals for addressing the nonlinearity and asymmetry of damper 8 are provided. However, damper 8 has the combined shape of the plurality of corrugations to reduce the movable load, as discussed above. As long as damper 8 is combined with edge 6 to form the suspension, it is difficult to improve performance of the speaker by solving the asymmetry and especially the nonlinearity and reducing the harmonic distortion.

Diaphragm 5 is required to be thick for securing rigidity thereof, the conventional speaker is essentially difficult to be thinned.

DISCLOSURE OF THE INVENTION

The present invention, for addressing the problems discussed above, provides a speaker having the following elements:

a magnetic circuit having a magnetic gap;

a voice coil body having a coil section movable in the magnetic gap;

a diaphragm of which inner periphery is coupled to the outside of the voice coil body and outer periphery is coupled to a frame via a first edge; and a suspension holder of which inner periphery is coupled to the voice coil body and outer periphery is coupled to the frame via a second edge. This suspension holder is disposed between the diaphragm and magnetic circuit. The diaphragm has a bent section between its outer periphery and inner periphery. The diaphragm and the suspension holder are coupled to each other in the bent section of the diaphragm.

The suspension is formed using the first edge and second edge as discussed above, a damper causing the nonlinearity and asymmetry can be omitted. Additionally, the second edge is configured to cancel the asymmetry of the first edge, and hence the nonlinearity and asymmetry of the suspension can be essentially solved. Thus, the harmonic distortion of the speaker can be reduced, the power linearity can be improved, and the performance of the speaker can be improved. A part from the bent section to the inner periphery of the diaphragm is supported by the suspension holder, so that the diaphragm is not required to be conical for securing rigidity thereof but even a flat diaphragm can be sufficiently rigid. Securing rigidity of diaphragm does not require large thickness thereof, so that the speaker of the present invention can be thinned.

DETAILED DESCRIPTION OF PREFERRED EMBODIMENTS

A speaker of the present invention has a diaphragm and a suspension holder disposed on the back surface of the diaphragm. In the diaphragm, a bent section is disposed between its inner periphery and outer periphery, the part from the bent section to the outer periphery is conical. The diaphragm is coupled to the suspension holder at the bent section of the diaphragm. Thanks to this configuration of the speaker, a damper causing the nonlinearity and asymmetry can be omitted, the harmonic distortion of the speaker can be reduced, the power linearity can be improved, and the performance of the speaker can be improved. The part from the bent section to the inner periphery of the diaphragm is supported by the suspension holder, so that rigidity can be sufficiently secured even when the diaphragm has a plane shape. Therefore, securing the rigidity of the diaphragm does not require large thickness of the diaphragm, and downsizing and low profile of the speaker can be realized.

Speakers in accordance of the embodiments of the present will be described hereinafter with reference to the following drawings.

Figure 1:
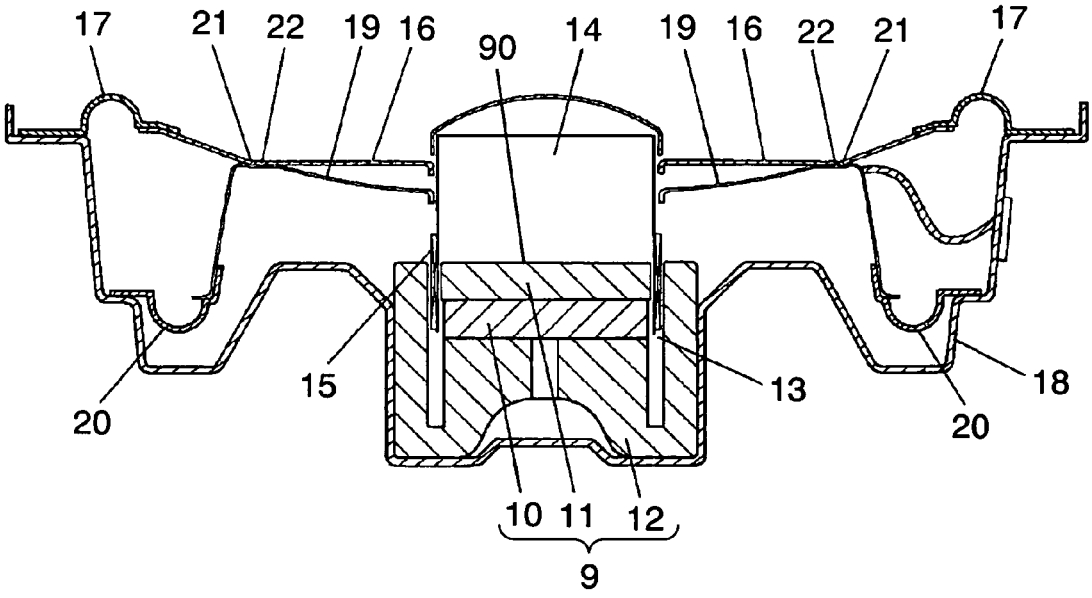
FIG. 1 is a sectional view of a speaker in accordance with exemplary embodiment 1 of the present invention.

(Exemplary embodiment 1) FIG. 1 is a sectional view of a speaker in accordance with exemplary embodiment 1 of the present invention. Magnetic circuit 9 has disk-like magnet 10, disk-like plate 11, and columnar yoke 12, and magnetic flux of magnet 10 is concentrated to magnetic gap 13 between the outer periphery of plate 11 and the inner periphery of yoke 12. Magnet 10 is mainly made of ferrite material or rare-earth cobalt material, and plate 11 and yoke 12 are mainly made of iron. Magnetic circuit 9 has top surface 90 and a bottom surface, the top surface corresponds to the upside surface of magnetic circuit 9 in FIG. 1, and the bottom surface corresponds to the downside surface of magnetic circuit 9. In FIG. 1, the bottom surface of magnetic circuit 9 is surrounded by frame 18. Cylindrical voice coil body 14 has coil section 15 movable in magnetic gap 13. Voice coil body 14 is configured so that coil section 15 is moved in magnetic gap 13 by a magnetic field of magnetic gap 13 when current is made to flow through coil section 15. Voice coil body 14 has a bobbin made of paper, resin, or metal such as aluminum, and coil section 15 formed by winding a coil such as a copper wire on the bobbin.

Figure 2:
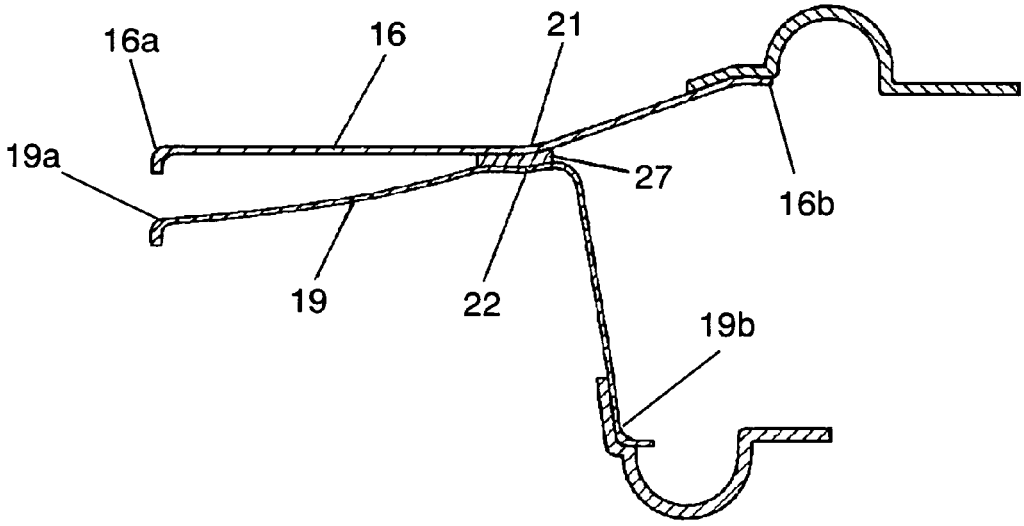
FIG. 2 is an enlarged view of a proximity of a coupling section of a diaphragm of the speaker to a suspension holder in accordance with exemplary embodiment 1.

Referring to FIG. 2, in diaphragm 16, the part from inner periphery 16*a* of the diaphragm to bent section 21 is formed in a plane shape, and the part from bent section 21 to outer periphery 16*b* of the diaphragm is formed in a conical shape. Diaphragm 16 has a front surface and a back surface. The front surface corresponds to the upside surface of diaphragm 16 in FIG. 1, and the back surface corresponds to the downside surface of diaphragm 16 in FIG. 1. Inner periphery 16*a* is coupled to the outside of voice coil body 14, and outer periphery 16*b* is coupled to frame 18 via first edge 17. Diaphragm 16 and suspension holder 19 are coupled to bent section 21 using an adhesive or the like. Part of suspension holder 19 coupling to diaphragm 16 is defined as coupling section 22.

Diaphragm 16 actually produces a sound due to vibration generated in voice coil body 14, and is mainly made of pulp and resin having both high rigidity and internal loss. The density of pulp or the like contained in material of the outer periphery of diaphragm 16 is set higher than that of the inner periphery with respect to bent section 21 of diaphragm 16. Here, the outer periphery of diaphragm 16 indicates the part from bent section 21 to outer periphery 16*b*, and the inner periphery of diaphragm 16 indicates the part from bent section 21 to inner periphery 16*a*. Diaphragm 16 is not necessarily required to be flat, but may have a shape having some unevenness.

The first edge 17 is coupled to outer periphery 16*b*, has a semicircular shape, and is made of urethane, rubber, or cloth to prevent a movable load from being charged on diaphragm 16. Bowl-like frame 18 coupled to outer periphery 16*b* via first edge 17 is made of a press piece of an iron plate, a resin molded piece, or aluminum die cast. These materials can respond to a complex shape.

Suspension holder 19 is disposed is disposed between diaphragm 16 and magnetic circuit 9. Inner periphery (holder inner periphery) 19*a* of suspension holder 19 is coupled to voice coil body 14, and outer periphery (holder outer periphery) 19*b* of suspension holder 19 is coupled to frame 18 via second edge 20. Suspension holder 19 is mainly made of pulp and resin having both high rigidity and internal loss. The density of pulp or the like contained in material of the outer periphery of suspension holder 19 is set higher than that of the inner periphery with respect to coupling section 22 of suspension holder 19. Here, the outer periphery of suspension holder 19 indicates the part from coupling section 22 of suspension holder 19 to holder outer periphery 19*b*, and the inner periphery of suspension holder 19 indicates the part from coupling section 22 of suspension holder 19 to holder inner periphery 19*a*.

Second edge 20 for coupling holder outer periphery 19*b* to frame 18 is made of urethane, rubber, or cloth to prevent a movable load from being charged on suspension holder 19, similarly to first edge 17.

First edge 17 is projected in the direction opposite to magnetic circuit 9, namely in the front direction of the diaphragm. Second edge 20 is projected in the bottom direction of magnetic circuit 9, namely in the back direction of the diaphragm.

Suspension holder 19 is coupled to bent section 21 of diaphragm 16 via elastic body 27 at coupling section 22 disposed between holder inner periphery 19*a* and holder outer periphery 19*b*. As elastic body 27, a member having elasticity after adhesion of a silicon-based adhesive or the like can be used. Diaphragm 16 and suspension holder 19 may be inter-coupled by disposing adhesive layers on both surfaces of the coupling section made of rubber elastic body.

Figure 3:
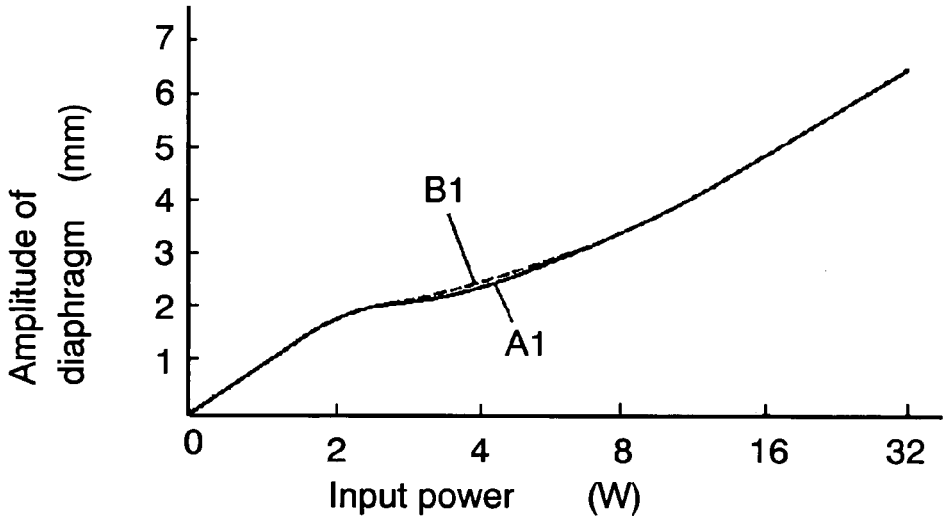
FIG. 3 is a characteristic diagram showing power linearity of the speaker in accordance with exemplary embodiment 1.

FIG. 3 shows amplitude of diaphragm 16 with respect to input power, namely power linearity, of the speaker of exemplary embodiment 1 of the present invention. Curve A1 shows a diaphragm amplitude characteristic with respect to input power to the magnetic circuit 9 side. Curve B1 shows a diaphragm amplitude characteristic with respect to input power to the opposite side to the magnetic circuit 9.

Figure 4:
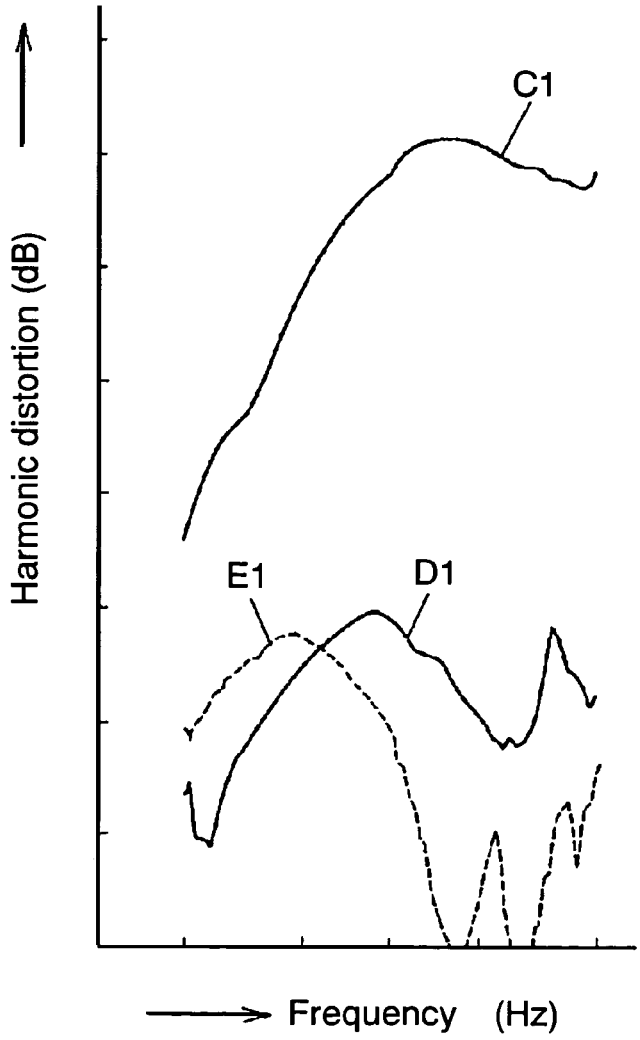
FIG. 4 is a characteristic diagram showing harmonic distortion characteristics of the speaker in accordance with exemplary embodiment 1.

FIG. 4 shows harmonic distortion characteristics of the speaker of exemplary embodiment 1, and shows that the larger the dynamic range of the output sound pressure and the harmonic distortion is, the lower the harmonic distortion is. Curve C1 shows an output sound pressure characteristic, curve D1 shows a second harmonic distortion characteristic, and curve E1 shows a third harmonic distortion characteristic.

Operations of the speaker of exemplary embodiment 1 having the configuration discussed above are described hereinafter.

When an electric signal output from an audio amplifier or the like is fed into coil section 15 of voice coil body 14, voice coil body 14 starts to vibrate, the vibromotive force is transmitted to diaphragm 16, and diaphragm 16 vibrates air to convert the electric signal to voice.

A suspension by suspension holder 19 and second edge 20, instead of a conventional damper, is disposed between voice coil body 14 and frame 18. Suspension holder 19, second edge 20, and first edge 17 constitute the suspension to prevent voice coil body 14 from rolling during moving.

Since the suspension includes first edge 17 and second edge 20, a damper causing the nonlinearity and asymmetry can be omitted. Disposing second edge 20 can cancel the asymmetry of first edge 17.

First edge 17 is projected in the direction opposite to magnetic circuit 9, and second edge 20 is projected toward magnetic circuit 9. Second edge 20 is configured to cancel the asymmetry of first edge 17.

The nonlinearity and asymmetry can be therefore, fundamentally solved, as shown in the input power—diaphragm amplitude characteristics of power linearity shown by curves A1 and B1 of FIG. 3. Moving contact between first edge 17 and second edge 20 can be prevented even when first edge 17 and second edge 20 are close to each other, so that increasing amplitude margin of the speaker can increase maximum sound pressure.

FIG. 4 shows harmonic distortion characteristics of the speaker of exemplary embodiment 1. As shown in the second harmonic distortion characteristic of curve D1 and the third harmonic distortion characteristic of curve E1, the harmonic distortion caused by the nonlinearity and the asymmetry of the suspension can be reduced, and performance of the speaker is increased.

In the speaker of exemplary embodiment 1, diaphragm 16 is coupled to suspension holder 19 at bent section 21. Phases of diaphragm 16 and suspension holder 19 are thus substantially the same, so that resonance distortion of an intermediate and low tone region caused by phase shift between diaphragm 16 and suspension holder 19 can be reduced, and the frequency characteristic can be flattened.

Since diaphragm 16 has bent section 21, strengths of bent section 21 and the inner periphery of the diaphragm become significant when diaphragm 16 vibrates. However, suspension holder 19 supports bent section 21, so that the strength of diaphragm 16 can be kept sufficient even when diaphragm 16 has a plane shape.

In the conventional speaker having no coupling structure of diaphragm 16 to suspension holder 19 differently from the speaker of embodiment 1, for keeping the strength of diaphragm 16, the part from the inner periphery to the outer periphery of diaphragm 16 is required to have a conical shape. While, in the speaker of exemplary embodiment 1, diaphragm 16 is coupled to suspension holder 19 at bent section 21, and the region from bent section 21 to voice coil body 14 has a double structure of diaphragm 16 and suspension holder 19, so that the strength in the part from the bent section to the inner periphery of diaphragm 16 can be kept. As shown in sectional views of FIG. 1 and FIG. 2, the following three points form a triangle, so that the strengths of the inner periphery of diaphragm 16 and the inner periphery of suspension holder 19 can be kept sufficient. The part from bent section 21 to the inner periphery may be therefore made flat. Here, three points indicate a bonded portion between diaphragm 16 and suspension holder 19, a bonded portion between diaphragm inner periphery 16*a* and voice coil body 14, and a bonded portion between holder inner periphery 19*a* and voice coil body 14.

Figure 5:
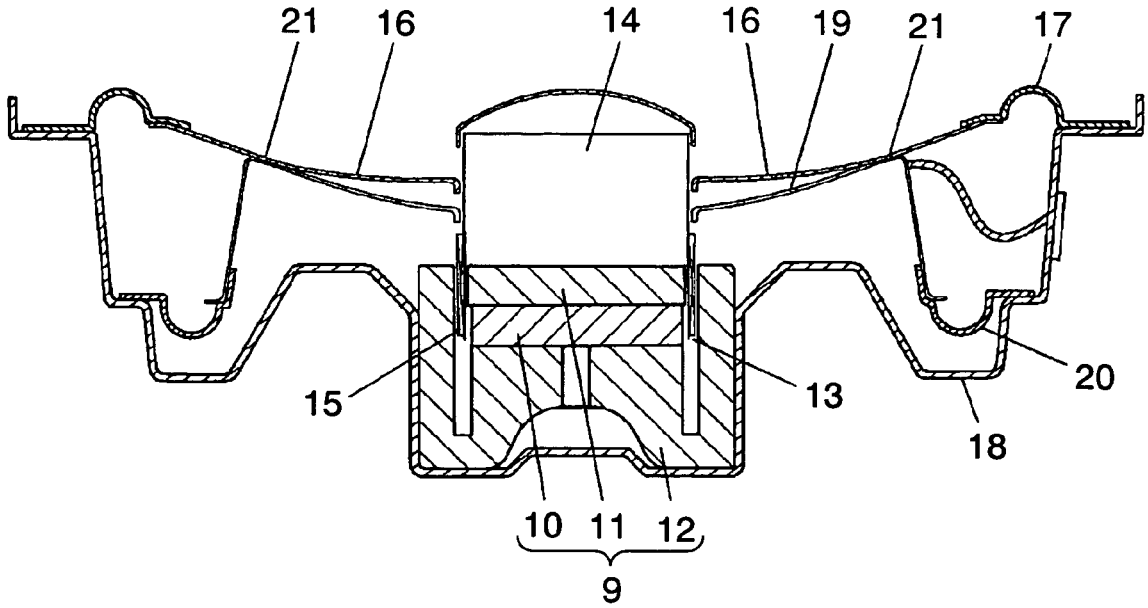
FIG. 5 is a sectional view of a speaker where a part from the inner periphery to the bent section of the diaphragm has a conical shape in accordance with exemplary embodiment 1.
Figure 6:
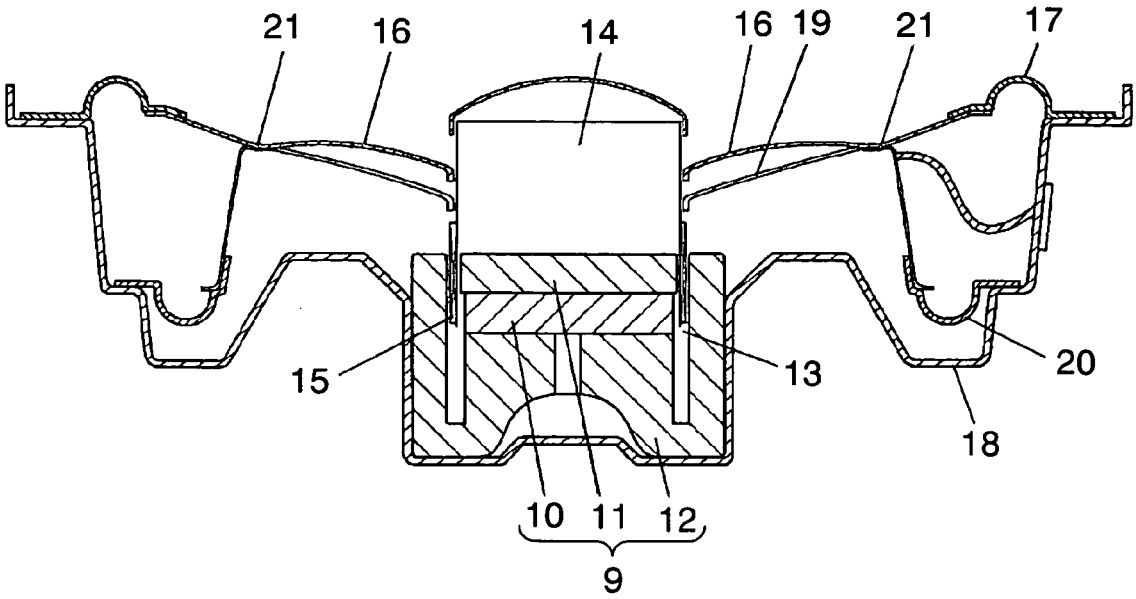
FIG. 6 is a sectional view of a speaker where a part from the inner periphery to the bent section of the diaphragm has an inverted conical shape in accordance with exemplary embodiment 1.

Comparing the speaker of exemplary embodiment 1 with the conventional speaker, a difference between the height position of diaphragm inner periphery 16*a* and height position of bent section 21 can be set the same or at least lower than that of the conventional speaker, so that downsizing and low profile of the speaker can be realized. The part from the inner periphery of diaphragm 16 to bent section 21 is made flat in the speaker of exemplary embodiment 1; however, the part from the inner periphery to bent section 21 may be made to have a conical shape as shown in FIG. 5. The part from the inner periphery to bent section 21 may be made to have an inverted conical shape as shown in FIG. 6. This conical shape means a conical shape projecting on the back side in the range from the inner periphery to the outer periphery of diaphragm 16. This inverted conical shape means a conical shape recessed in the back side in the range from the inner periphery to the outer periphery of diaphragm 16.

Figure 7:
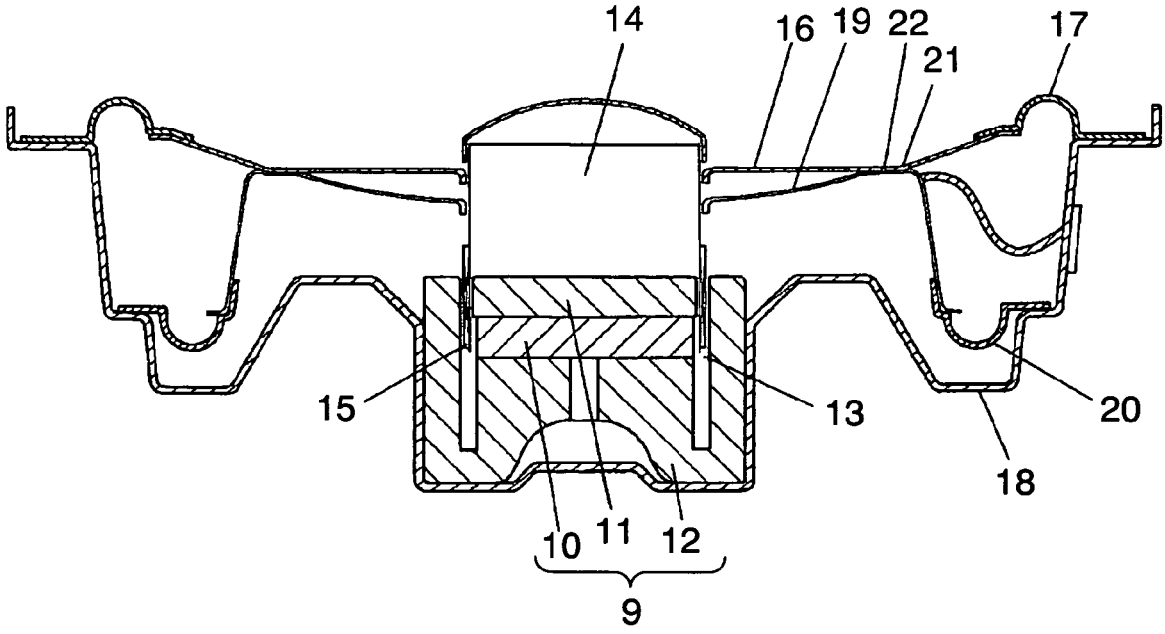
FIG. 7 is a sectional view of a speaker where the bent section of the diaphragm is disposed on the outer peripheral side of the center of the diaphragm in accordance with exemplary embodiment 1.

Bent section 21 does not necessarily need to be disposed in the center of diaphragm 16, but may be disposed on the outer periphery side of the center of diaphragm 16 as shown in FIG. 7. When bent section 21 is disposed on the further outer periphery side of diaphragm 16, coupling section 22 to suspension holder 19 can be disposed at a node where rigidity of diaphragm 16 decreases. Therefore, rigidity of diaphragm 16 can be improved. The part from the inner periphery of diaphragm 16 to bent section 21 is made to have a larger plane shape, so that downsizing and low profile of the speaker can be realized.

Additionally, the shape from the inner periphery of diaphragm 16 to bent section 21 is not limited to the shape discussed above in the speaker of exemplary embodiment 1, but may be any shape if the speaker has bent section 21 for coupling suspension holder 19 to diaphragm 16.

Pulp and resin can be used for suspension holder 19. Suspension holder 19 in the speaker of exemplary embodiment 1 is made of pulp. In this case, weight increase can be suppressed while the elastic modulus and the internal loss of suspension holder 19 are secured, and efficiency reduction of the speaker due to weight increase of the vibration system can be suppressed.

Paper, resin, and metal such as aluminum can be used for the bobbin of voice coil body 14, but suspension holder 19 and the bobbin of voice coil body 14 may be made of metal material having high thermal conductivity. In this case, heat generated in coil section 15 can be efficiently radiated to a space through the bobbin of voice coil body 14 and suspension holder 19, and hence temperature increase of coil section 15 can be suppressed. Diaphragm 16, suspension holder 19, and voice coil body 14 can be therefore prevented from falling off even when an adhesive of which adhesive strength decreases at high temperature is employed. As a result, the adhesive strength of voice coil body 14 to diaphragm 16 and suspension holder 19 can be kept sufficient, and input resistance of the speaker can be improved.

The elastic modulus of first edge 17 and that of second edge 20 are preferably set to be substantially equal. Thus, second edge 20 can more accurately cancel the nonlinearity and asymmetry of first edge 17, the nonlinearity and asymmetry of the suspension can be largely solved, and the harmonic distortion or power linearity of the speaker can be remarkably improved.

First edge 17 and second edge 20 can be made of urethane, rubber, or cloth, but are preferably made of urethane. In the speaker of exemplary embodiment 1 having first edge 17 and second edge 20, thus, weight increase of the vibration system can be suppressed, and efficiency reduction of the speaker due to the weight increase of the vibration system can be suppressed.

The inner periphery of diaphragm 16 and the inner periphery of suspension holder 19 form a double support structure, so that they have a sufficient rigidity as a whole. When the density of the outer periphery of diaphragm 16 is set higher than that of the inner periphery of diaphragm 16 with respect to bent section 21 of diaphragm 16, rigidity of the entire diaphragm can be improved. In this case, the weight of the diaphragm can be reduced comparing with a case where the density of the entire diaphragm is increased to improve rigidity, so that the efficiency reduction of the speaker can be significantly suppressed.

When the density of the outer periphery of suspension holder 19 is set higher than that of the inner periphery with respect to coupling section 22 of suspension holder 19, rigidity of the entire suspension holder 19 can be improved. In this case, the weight of the diaphragm can be reduced comparing with a case where the density of the entire suspension holder 19 is increased to improve rigidity, so that the efficiency reduction of the speaker can be significantly suppressed.

As shown in FIG. 2, coupling section 22 between the inner periphery and the outer periphery of suspension holder 19 is coupled to bent section 21 of diaphragm 16 through elastic body 27. Phase of diaphragm 16 and phase of suspension holder 19 are thus substantially the same, so that resonance distortion of an intermediate and low tone region caused by phase shift between diaphragm 16 and suspension holder 19 can be reduced, and the frequency characteristic can be flattened.

Diaphragm 16 and suspension holder 19 have a dimension error occurring during manufacturing, so that a clearance can occur in the bent section of diaphragm 16 and suspension holder 19. This clearance can be filled by elastic body 27, and the elasticity of elastic body 27 can prevent deformation of the structure of diaphragm 16 and suspension holder 19. The distortion as the speaker can be therefore reduced.

An inner magnetism type speaker is described in exemplary embodiment 1 of the present invention; however, the present invention can be also applied to an outer magnetism type speaker.

(Exemplary embodiment 2) A speaker in accordance with exemplary embodiment 2 of the present invention is described with reference to FIG. 8. The basic configuration of the speaker is similar to that of the speaker of embodiment 1 of the present invention, but projecting directions of first edge 17 and second edge 20 are different from those of the speaker of embodiment 1.

Figure 8:
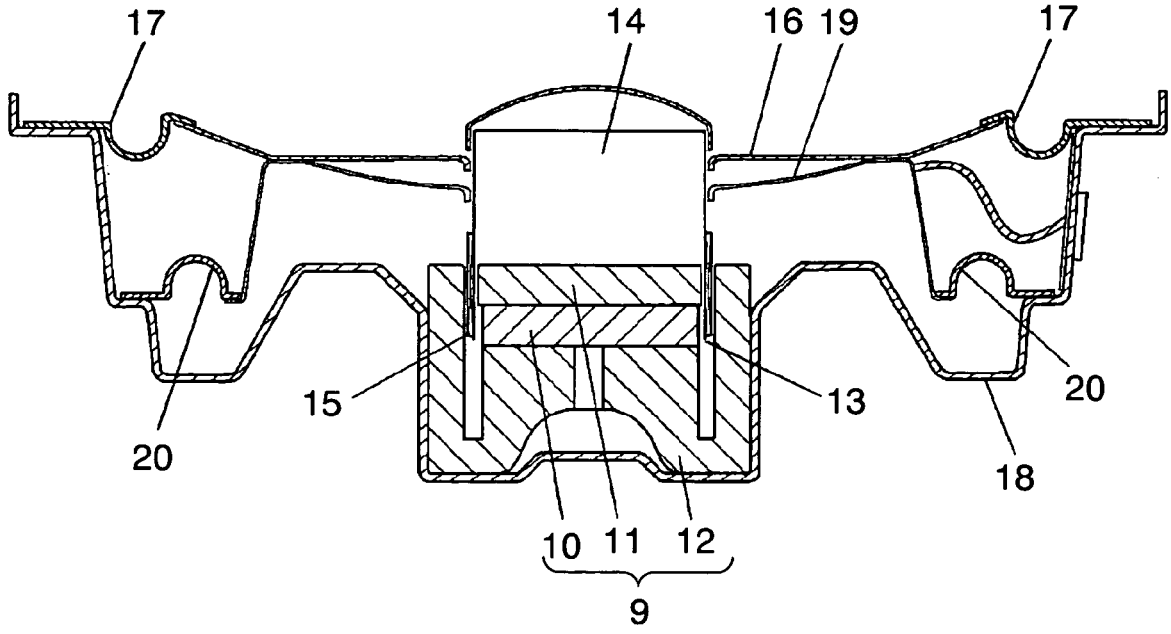
FIG. 8 is a sectional view of a speaker in accordance with exemplary embodiment 2 of the present invention.

As shown in FIG. 8, first edge 17 is projected toward magnetic circuit 9, namely in the back direction of the diaphragm, and second edge 20 is projected in the front direction of the diaphragm.

Thus, even when an acoustic opening such as a net is close to the front side of first edge 17, contact of first edge 17 with the protective net can be prevented. Increasing amplitude margin of the speaker can therefore increase maximum sound pressure.

(Exemplary embodiment 3)

A speaker in accordance with exemplary embodiment 3 of the present invention is described with reference to FIG. 9. The basic configuration of the speaker is similar to that of the speaker of embodiment 1 of the present invention, but the speaker of embodiment 3 differs from the speaker of embodiment 1 in that the outer periphery of suspension holder 19 is coupled through the second edge 20, on the bottom side of magnetic circuit 9, and below top surface 90 of plate 11.

Figure 9:
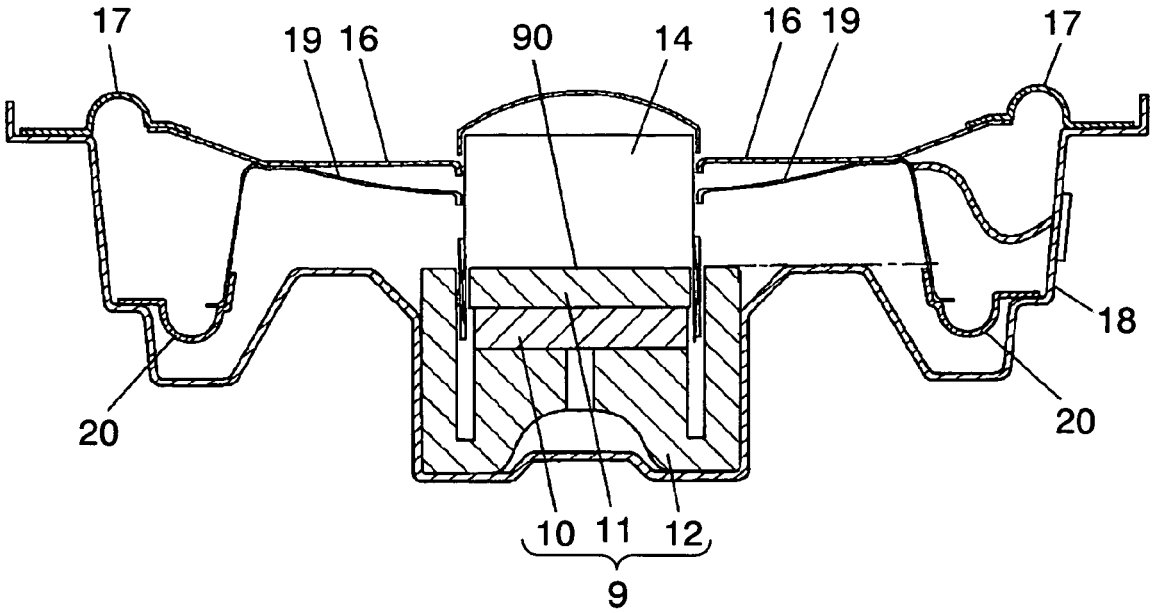
FIG. 9 is a sectional view of a speaker in accordance with exemplary embodiment 3 of the present invention.

Thanks to the configuration of FIG. 9, the distance between fulcrums of first edge 17 and second edge 20 can be made as long as possible, so that rolling of voice coil body 14 during moving can be minimized. In other words, the original position of voice coil body 14 during moving lies between the coupling point of first edge 17 with frame 18, namely the fulcrum of voice coil body 14, and the coupling point of second edge 20 with frame 18. The original position of voice coil body 14 indicates the coupling point between voice coil body 14 and diaphragm 16, and means a driving point where voice coil body 14 starts to vibrate and the vibromotive force is transmitted to diaphragm 16 to vibrate it. In this configuration, the original position of voice coil body 14 and the fulcrums of the edges form a triangle, thereby stably supporting voice coil body 14 during moving.

(Exemplary embodiment 4) A speaker in accordance with exemplary embodiment 4 of the present invention is described with reference to FIG. 10. The basic configuration of the speaker is similar to that of the speaker of embodiment 1 of the present invention.

Figure 10:
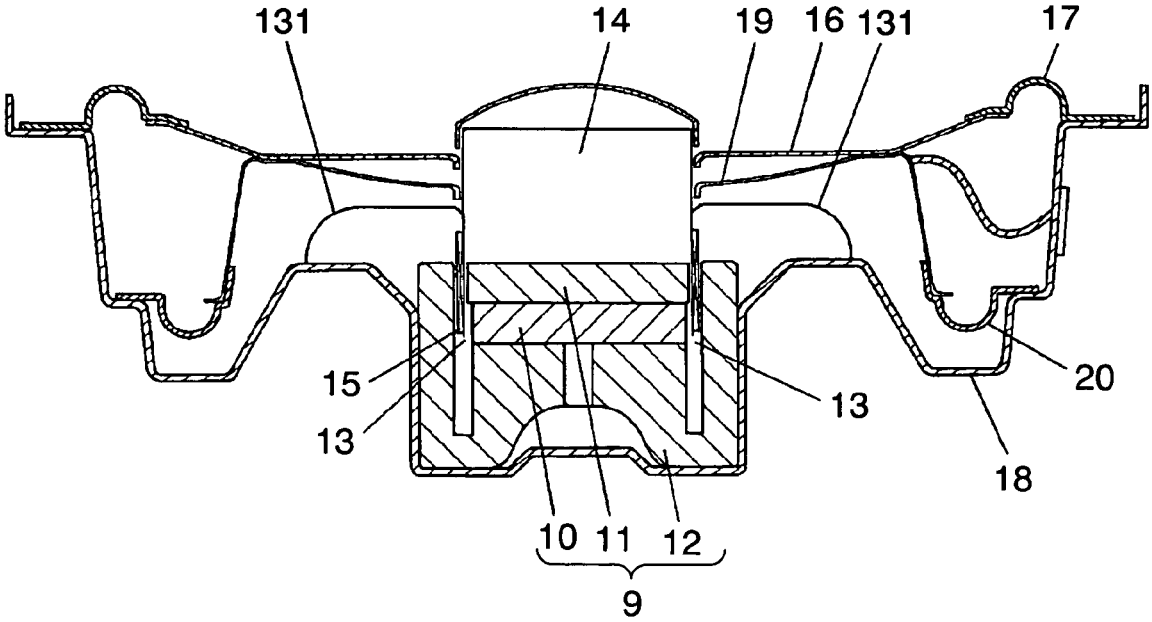
FIG. 10 is a sectional view of a speaker in accordance with exemplary embodiment 4 of the present invention.

In FIG. 10, the speaker of embodiment 4 has dustproof net 131 mounted between suspension holder 19 and magnetic circuit 9, thereby preventing dust or the like from coming into magnetic gap 13 of magnetic circuit 9.

(Exemplary embodiment 5) A speaker in accordance with exemplary embodiment 5 of the present invention is described with reference to FIG. 11. The basic configuration of the speaker is similar to that of the speaker of embodiment 1 of the present invention.

Figure 11:
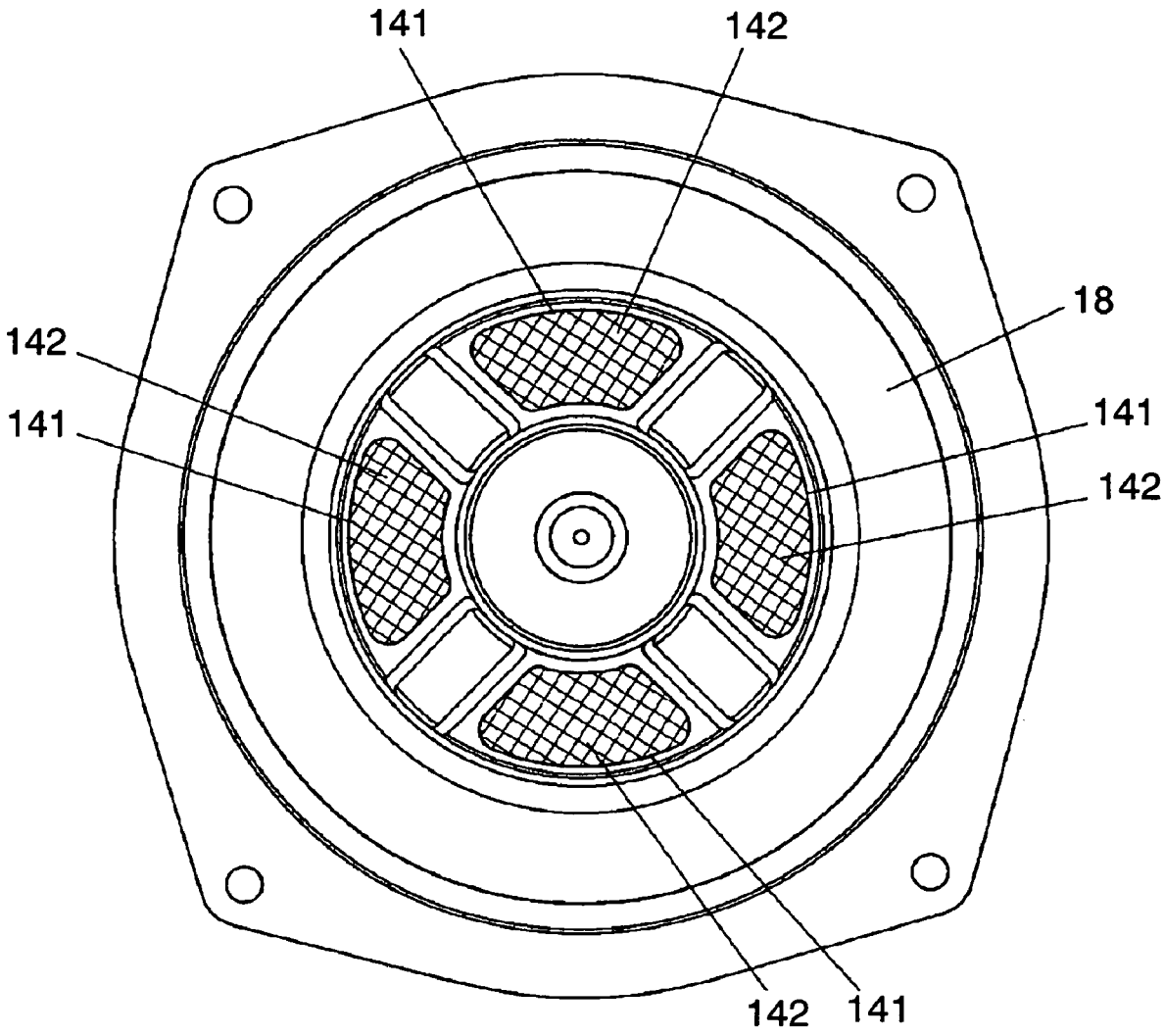
FIG. 11 is a back view of a speaker in accordance with exemplary embodiment 5 of the present invention.

In the speaker of embodiment 5, as shown in FIG. 11, frame 18 is coupled to magnetic circuit 9, ventilation holes 141 are formed in the bottom of frame 18, and dustproof nets 142 are disposed in ventilation holes 141. Dust or the like can be thus prevented from coming into magnetic gap 13 of magnetic circuit 9.

Figure 12:
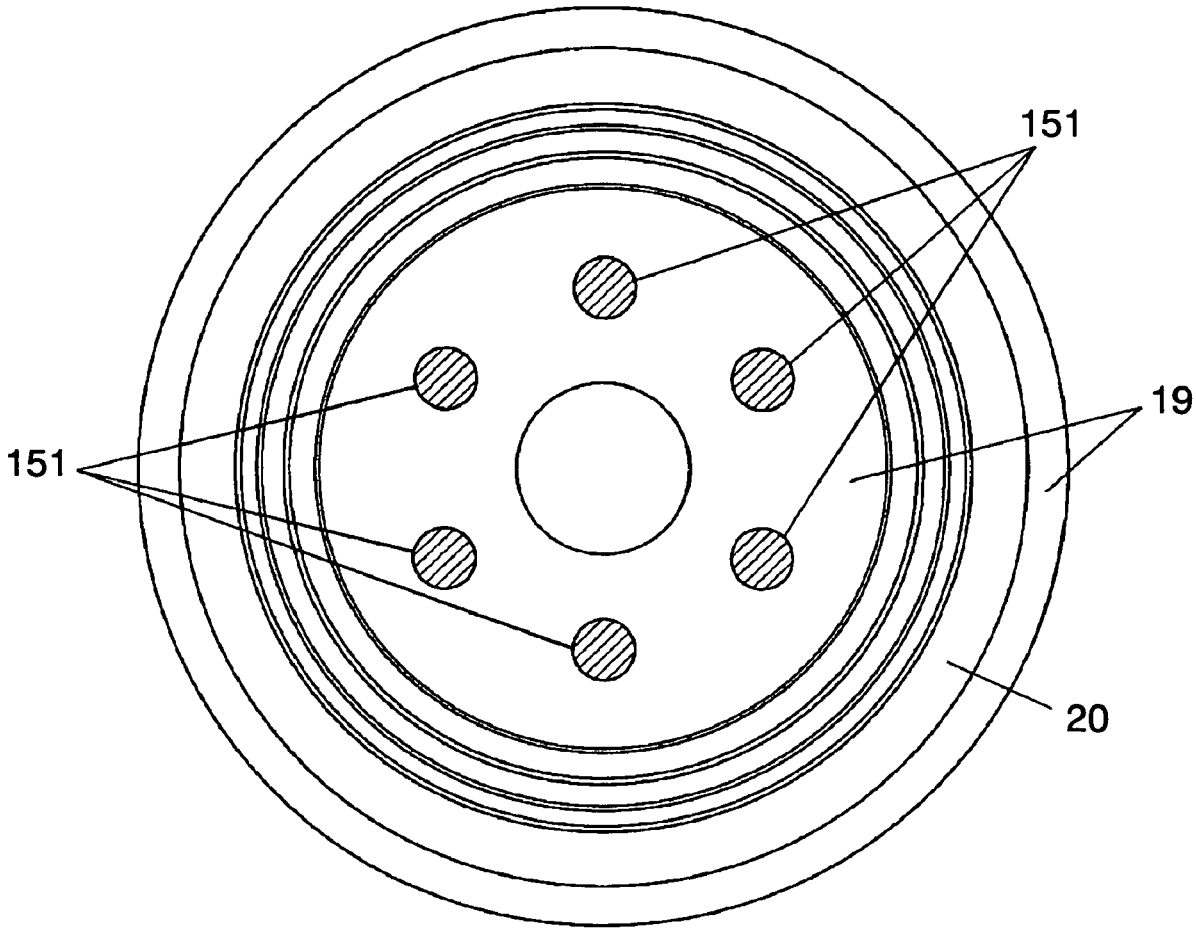
FIG. 12 is a back view of a suspension holder in accordance with exemplary embodiment 6 of the present invention.
Figure 13:
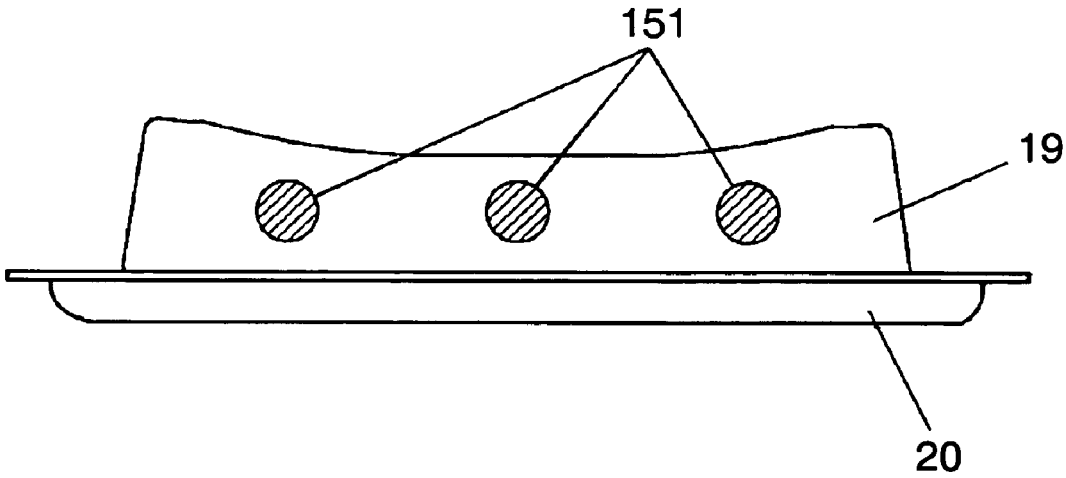
FIG. 13 is a side view of the suspension holder in accordance with exemplary embodiment 6 of the present invention.

(Exemplary embodiment 6) A speaker in accordance with exemplary embodiment 6 of the present invention is described with reference to FIG. 12 and FIG. 13. The basic configuration of the speaker is similar to that of the speaker of embodiment 1 of the present invention. FIG. 12 is a back view of the speaker in a non-existing state of frame 18, and FIG. 13 is a side view of the speaker in a non-existing state of frame 18.

As shown in FIG. 12, the speaker of embodiment 6 has openings 151 in the top surface of suspension holder 19. Here, the top surface of suspension holder 19 corresponds to the part on the inside of coupling section 22 of FIG. 1, and the side surface corresponds to the part on the outside of coupling section 22.

This configuration can suppress acoustic output in an intermediate and low tone region from suspension holder 19, and can hence suppress a trouble that the acoustic output of suspension holder 19 interferes with diaphragm 16 to reduce the acoustic characteristic of the speaker. In FIG. 13, the speaker of embodiment 6 has openings 151 in a side surface of suspension holder 19. This configuration can suppress acoustic output in an intermediate and low tone region from suspension holder 19, and can hence suppress a trouble that the acoustic output of suspension holder 19 interferes with diaphragm 16 to reduce the acoustic characteristic of the speaker.

(Exemplary embodiment 7) A speaker in accordance with exemplary embodiment 7 of the present invention is described with reference to FIG. 14. The basic configuration of the speaker is similar to that of the speaker of embodiment 1 of the present invention.

Figure 14:
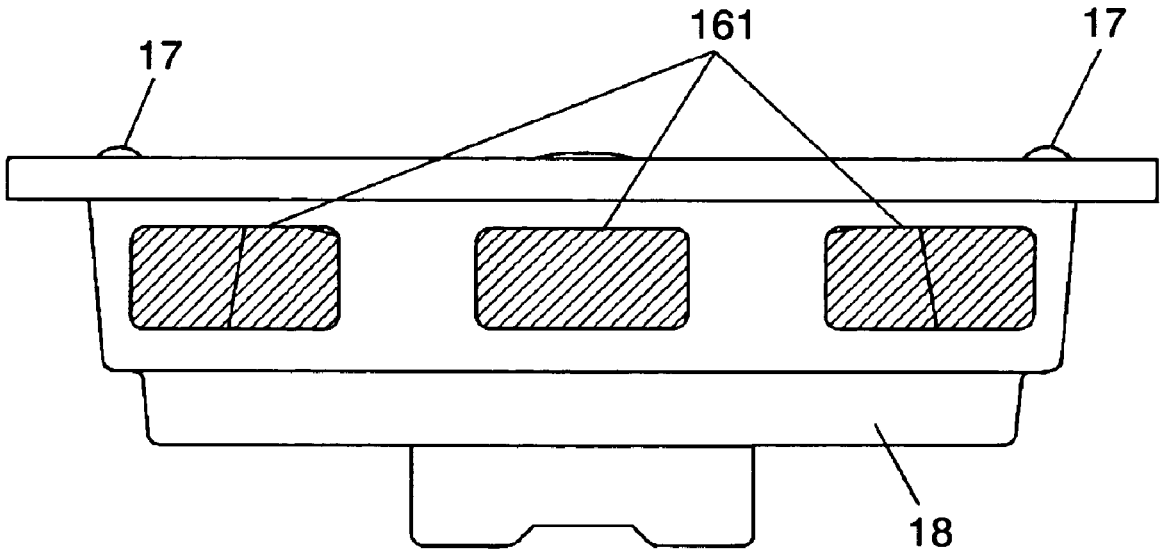
FIG. 14 is a side view of a speaker in accordance with exemplary embodiment 7 of the present invention.

The speaker of embodiment 7, as shown in FIG. 14, has openings 161 in frame 18 between first edge 17 and second edge 20. This configuration can prevent an intermediate chamber from being formed of diaphragm 16, first edge 17, frame 18, second edge 20, suspension holder 19, and voice coil body 14. In other words, it can be suppressed that forming the intermediate chamber makes the acoustic output of suspension holder 19 interfere with diaphragm 16 to reduce the acoustic characteristic of the speaker.

(Exemplary embodiment 8) A speaker in accordance with exemplary embodiment 8 of the present invention is described with reference to FIG. 15. The basic configuration of the speaker is similar to that of the speaker of embodiment 1 of the present invention.

Figure 15:
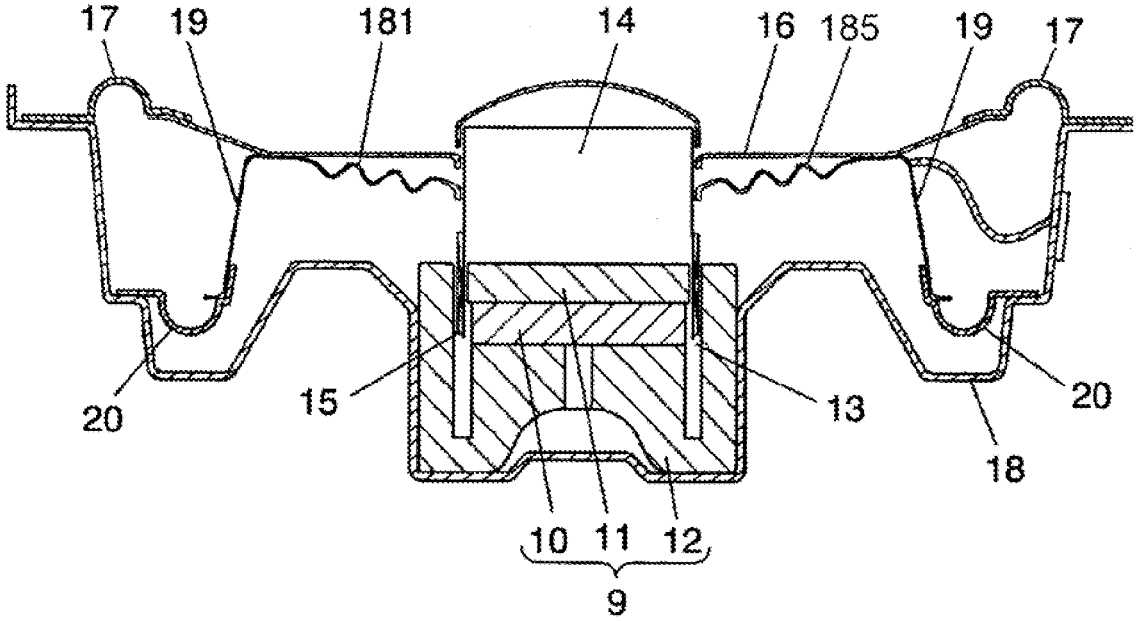
FIG. 15 is a sectional view of a speaker in accordance with exemplary embodiment 8 of the present invention.

In the speaker of embodiment 8, as shown in FIG. 15, the top surface of suspension holder 19 is corrugation surface 185. Using the corrugation shape can absorb resonance distortion at a high acceleration which first and second edges 17 and 20 cannot follow and in the intermediate tone region, so that the frequency characteristic of the intermediate tone region can be flattened.

(Exemplary embodiment 9) A speaker in accordance with exemplary embodiment 9 of the present invention is described with reference to FIG. 16. The basic configuration of the speaker is similar to that of the speaker of embodiment 1 of the present invention.

Figure 16:
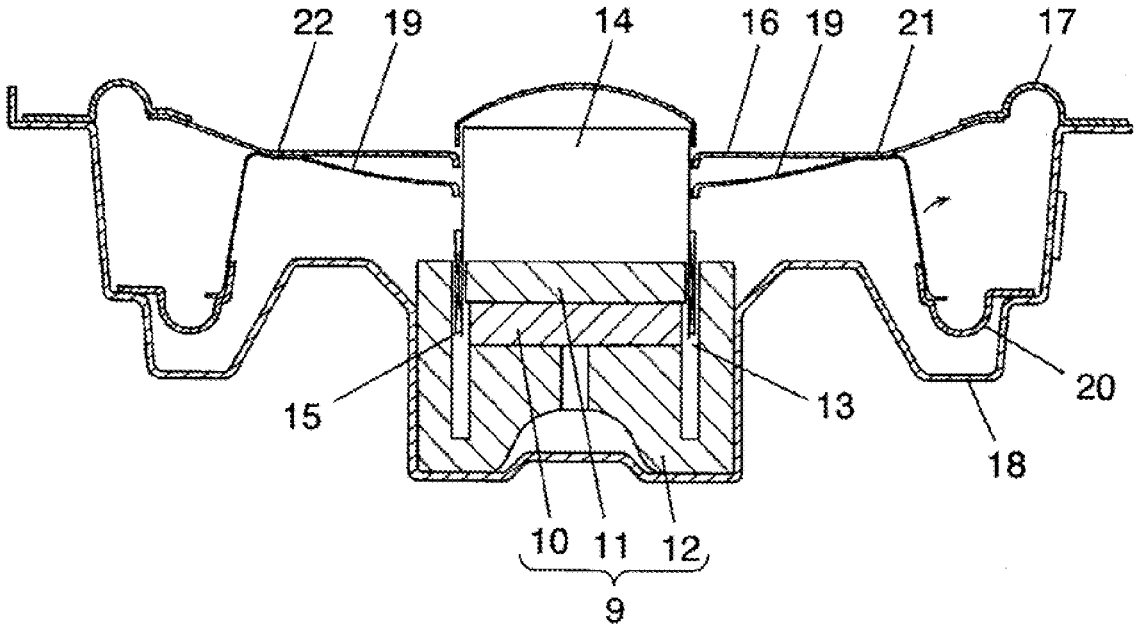
FIG. 16 is a sectional view of a speaker in accordance with exemplary embodiment 9 of the present invention.

In the speaker of embodiment 9, as shown in FIG. 16, suspension holder 19 has a shape where the part between coupling section 22 and the outer periphery of suspension holder 19 is bent in the outer periphery direction. The arrow of FIG. 16 indicates the outer periphery direction. This configuration can disperse stress applied to the part between bent section 21 and the outer periphery of suspension holder 19, so that rigidity of suspension holder 19 can be improved. Here, the part between bent section 21 and the outer periphery is apt to suffer the stress in the outer periphery direction. As a result, input resistance of the speaker can be further improved and distortion as the speaker can be reduced.

Figure 17:
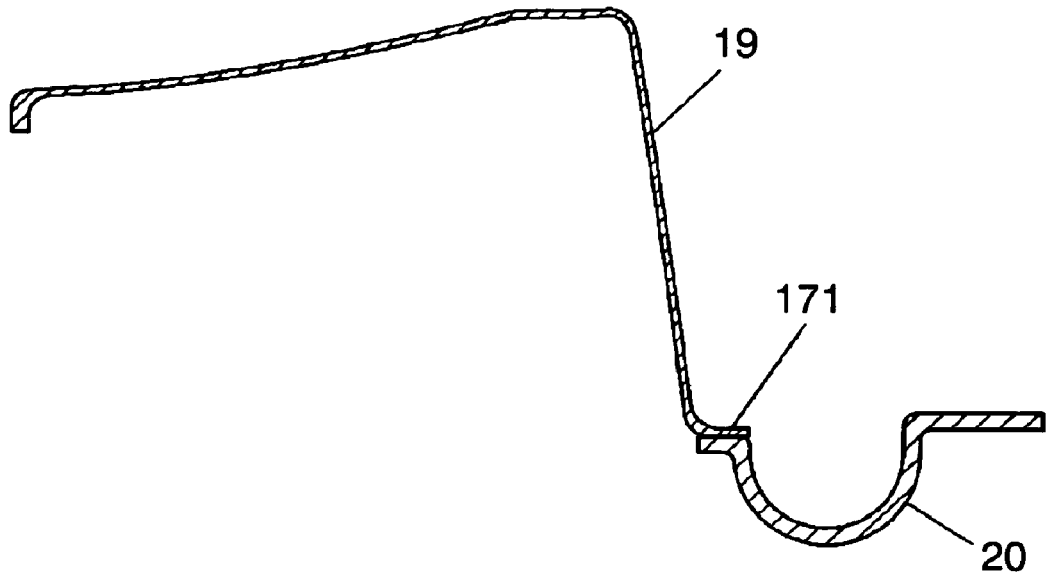
FIG. 17 is an enlarged view of a suspension holder and a second edge in accordance with exemplary embodiment 10 of the present invention.

(Exemplary embodiment 10) A speaker in accordance with exemplary embodiment 10 of the present invention is described with reference to FIG. 17. The basic configuration of the speaker is similar to that of the speaker of embodiment 1 of the present invention. FIG. 17 is an enlarged view of a coupling section between suspension holder 19 and second edge 20.

The outer periphery of suspension holder 19 is formed in an L shape, as shown in FIG. 17. Plane section 171 corresponding to the lower part of the L shape is coupled to second edge 20. Rigidity of the coupling section between suspension holder 19 and second edge 20 is thus increased, and stress applied to this coupling section can be more effectively dispersed, so that input resistance of the speaker can be further improved. The outer periphery of suspension holder 19 may be coupled to second edge 20 at not the entire surface of plane section 171 but part of plane section 171.

Figure 18:
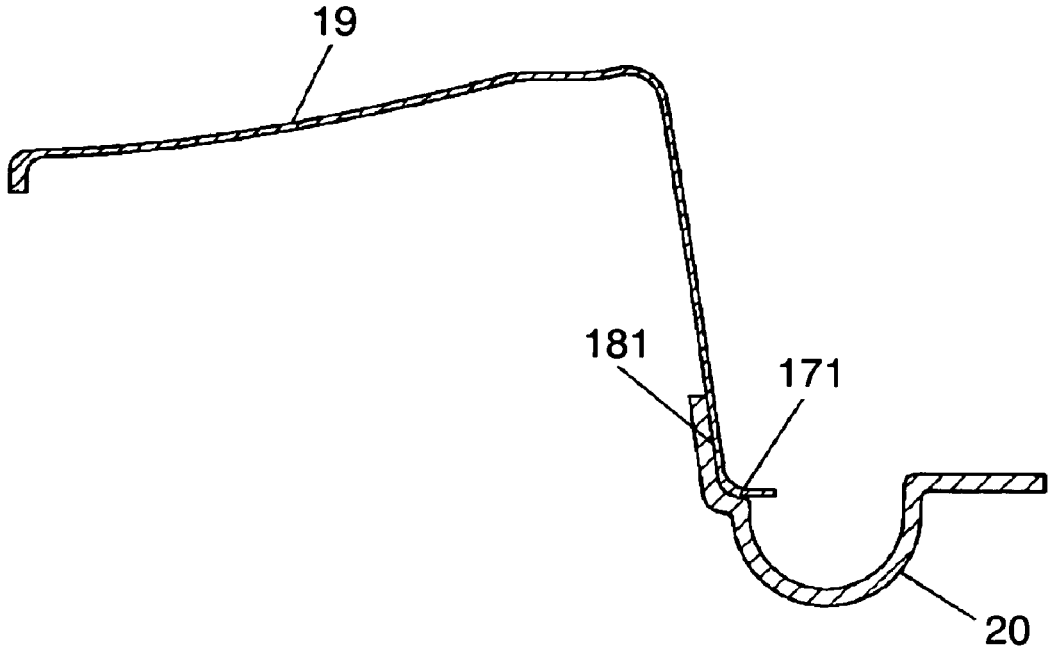
FIG. 18 is an enlarged view of a suspension holder and a second edge in accordance with exemplary embodiment 11 of the present invention.

(Exemplary embodiment 11) A speaker in accordance with exemplary embodiment 11 of the present invention is described with reference to FIG. 18. The basic configuration of the speaker is similar to that of the speaker of embodiment 1 of the present invention. FIG. 18 is an enlarged view of a coupling section between suspension holder 19 and second edge 20.

The outer periphery of suspension holder 19 is formed in an L shape, as shown in FIG. 18. A part corresponding to the lower part of the L shape is called plane section 171, and the substantially vertical part of the L shape is called erect section 181. Second edge 20 is coupled to plane section 171 and erect section 181 of the L shape of the outer periphery of suspension holder 19. Rigidity of the coupling section between suspension holder 19 and second edge 20 is thus increased, and stress applied to this coupling section can be more effectively dispersed, so that input resistance of the speaker can be further improved. The outer periphery of suspension holder 19 may be coupled to second edge 20 at not the entire surface of plane section 171 but part of plane section 171. The same concept is applied to erect section 181.

Figure 19:
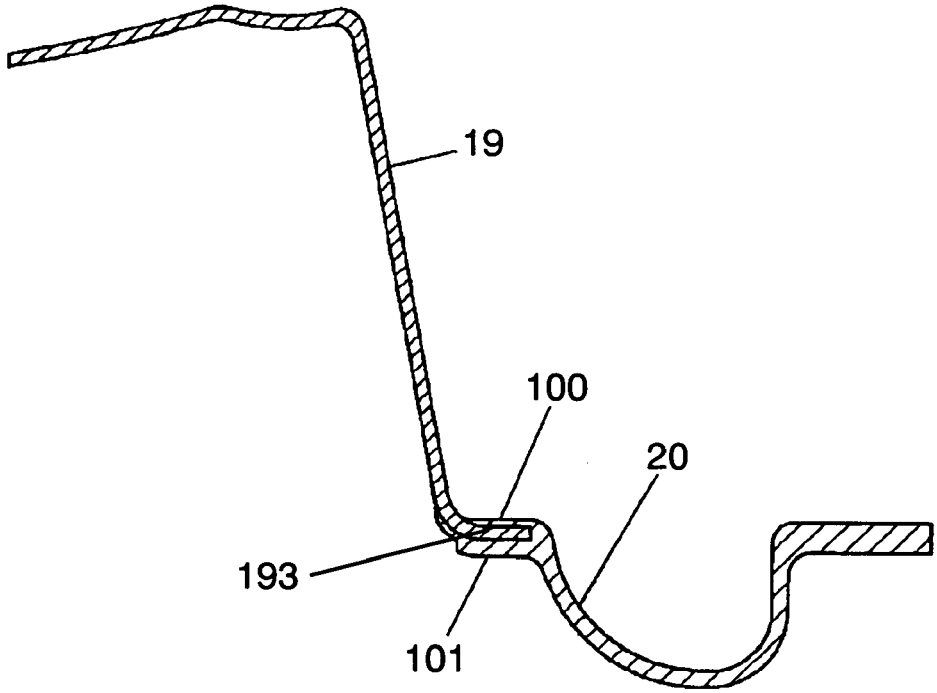
FIG. 19 is an enlarged view of a suspension holder and a second edge in accordance with exemplary embodiment 12 of the present invention.

Exemplary embodiment 12) A speaker in accordance with exemplary embodiment 12 of the present invention is described with reference to FIG. 19. The basic configuration of the speaker is similar to that of the speaker of embodiment 1 of the present invention. FIG. 19 is an enlarged view of a coupling section between suspension holder 19 and second edge 20.

The speaker of embodiment 12, as shown in FIG. 19, has upper edge section 100 and lower edge section 101 at one end of second edge 20, and outer periphery 193 of suspension holder 19 is grappled by upper edge section 100 and lower edge section 101 to be coupled to them. In other words, in a coupling section of suspension holder 19 to second edge 20, the outer periphery of suspension holder 19 is sandwiched between the tip parts of second edge 20. Rigidity of the coupling section between suspension holder 19 and second edge 20 is thus increased, and stress applied to this coupling section can be more effectively dispersed, so that input resistance of the speaker can be further improved.

Figure 20:
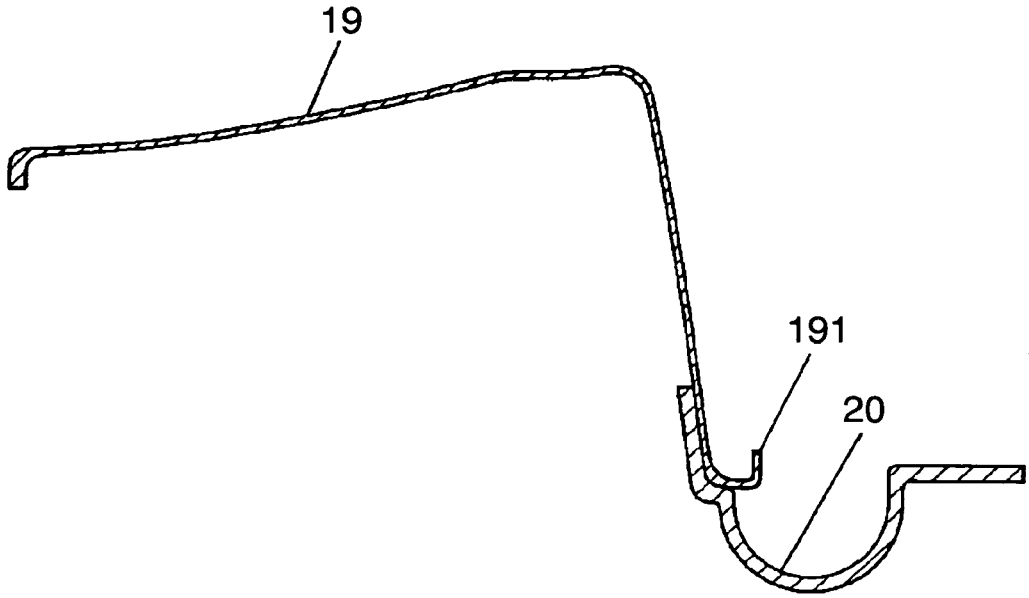
FIG. 20 is an enlarged view of a suspension holder and a second edge in accordance with exemplary embodiment 13 of the present invention.

(Exemplary embodiment 13) A speaker in accordance with exemplary embodiment 13 of the present invention is described with reference to FIG. 20. The basic configuration of the speaker is similar to that of the speaker of embodiment 1 of the present invention. FIG. 20 is an enlarged view of a coupling section between suspension holder 19 and second edge 20.

In the speaker of embodiment 13, as shown in FIG. 20, the outer periphery of suspension holder 19 is formed in an L shape, and the tip of the outer periphery has folded section 191 folded upward. Thanks to folded section 191, stress that is directed in the outer peripheral direction and is applied to the coupling section between suspension holder 19 and second edge 20 can be more effectively dispersed, rigidity of suspension holder 19 can be increased, and input resistance of the speaker can be further improved.

Figure 21:
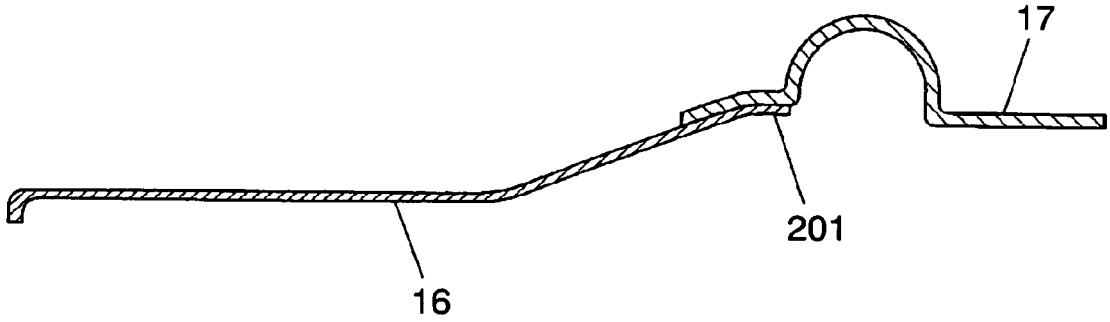
FIG. 21 is an enlarged view of a diaphragm of a speaker and a first edge in accordance with exemplary embodiment 14 of the present invention.

(Exemplary embodiment 14) A speaker in accordance with exemplary embodiment 14 of the present invention is described with reference to FIG. 21. The basic configuration of the speaker is similar to that of the speaker of embodiment 1 of the present invention. FIG. 21 is an enlarged view of a coupling section between diaphragm 16 and first edge 17.

In the speaker of embodiment 14, as shown in FIG. 21, tip 201 of the outer periphery of diaphragm 16 is folded and extended. The coupling section between diaphragm 16 and first edge 17 is thus reinforced to increase rigidity of diaphragm 16, stress applied to the coupling section can be dispersed, and input resistance of the speaker can be further improved.

(Exemplary embodiment 15) A speaker in accordance with exemplary embodiment 15 of the present invention is described with reference to FIG. 22. The basic configuration of the speaker is similar to that of the speaker of embodiment 1 of the present invention.

Figure 22:
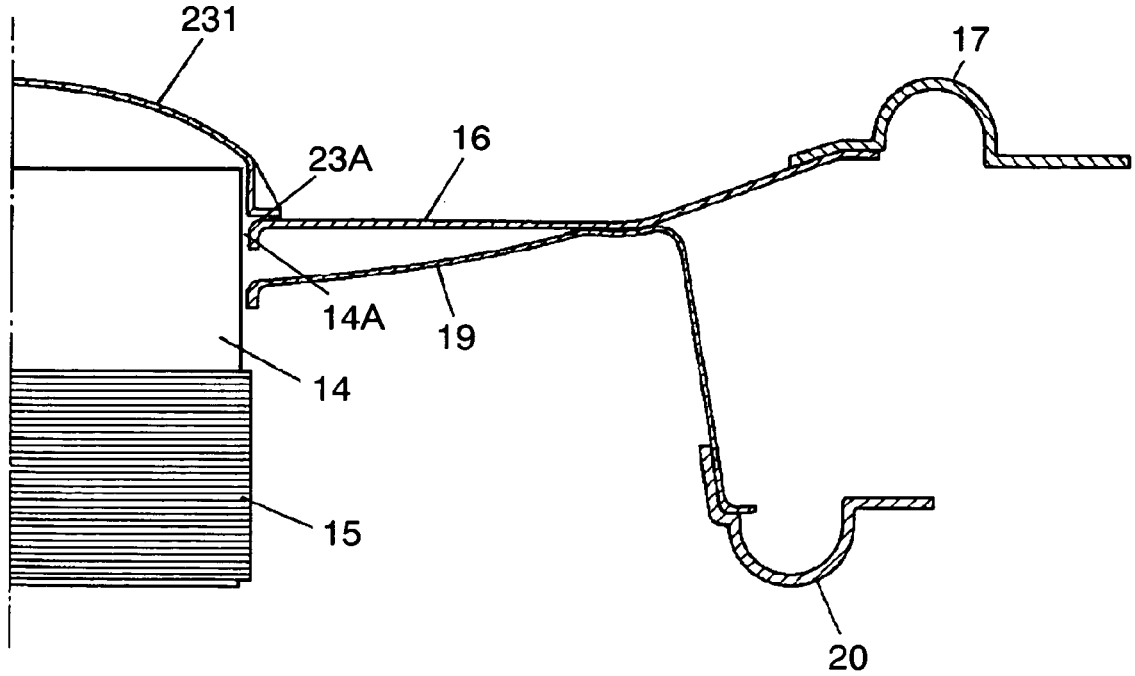
FIG. 22 is a sectional view of an essential part of a speaker in accordance with exemplary embodiment 15 of the present invention.

In the speaker of embodiment 15, as shown in FIG. 22, dust cap 231 is coupled to diaphragm 16 and is disposed for preventing dust or the like from coming into magnetic circuit 9. Dust cap 231 is coupled to diaphragm 16 at coupling place 23A using an adhesive so as to cover the coupling section between voice coil body 14 and the inner periphery of diaphragm 16. Dust cap 231 is mainly made of pulp and resin. As the material of the adhesive, a general adhesive such as an acrylic adhesive, a silicon adhesive, or a rubber adhesive is used.

Dust cap 231 is coupled to not only diaphragm 16 but also voice coil body 14 at coupling place 14A via the adhesive. In other words, diaphragm 16 is fixed at two places of dust cap 231 and voice coil body 14.

Fixing strength of diaphragm 16 to voice coil body 14 is increased, balance between the behavior where voice coil body 14 comes close to magnetic circuit 9 and the behavior where voice coil body 14 gets away from magnetic circuit 9 is improved, and a driving force of voice coil body 14 can be precisely transmitted to diaphragm 16, so that distortion of the speaker can be reduced.

Figure 23:
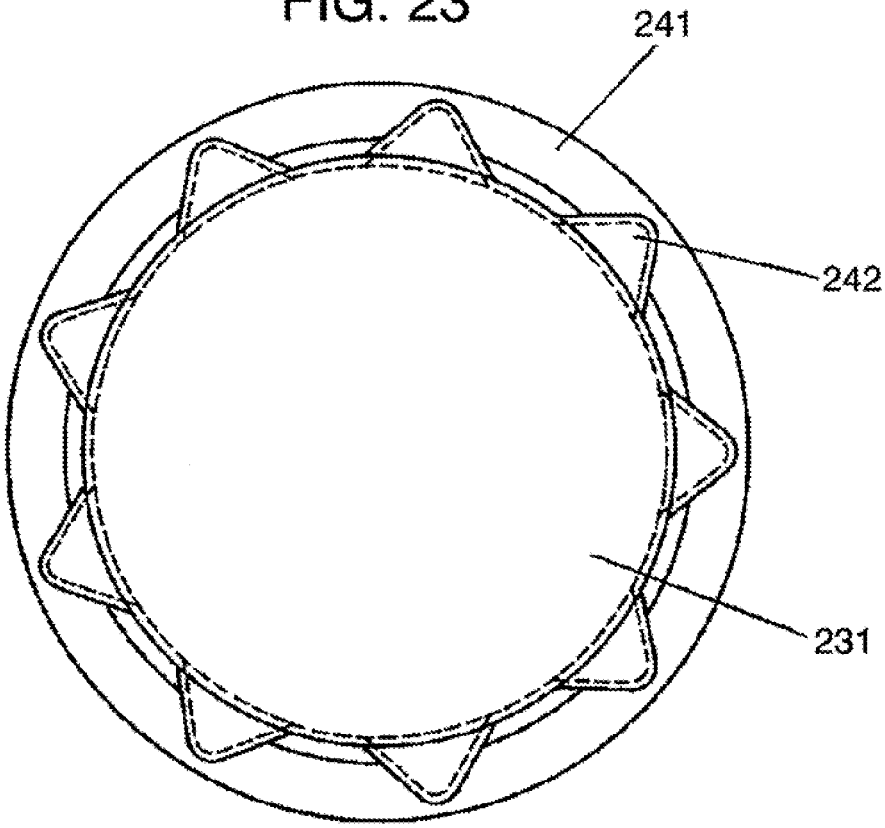
FIG. 23 is a front view of a dust cap in accordance with exemplary embodiment 16 of the present invention.
Figure 24:
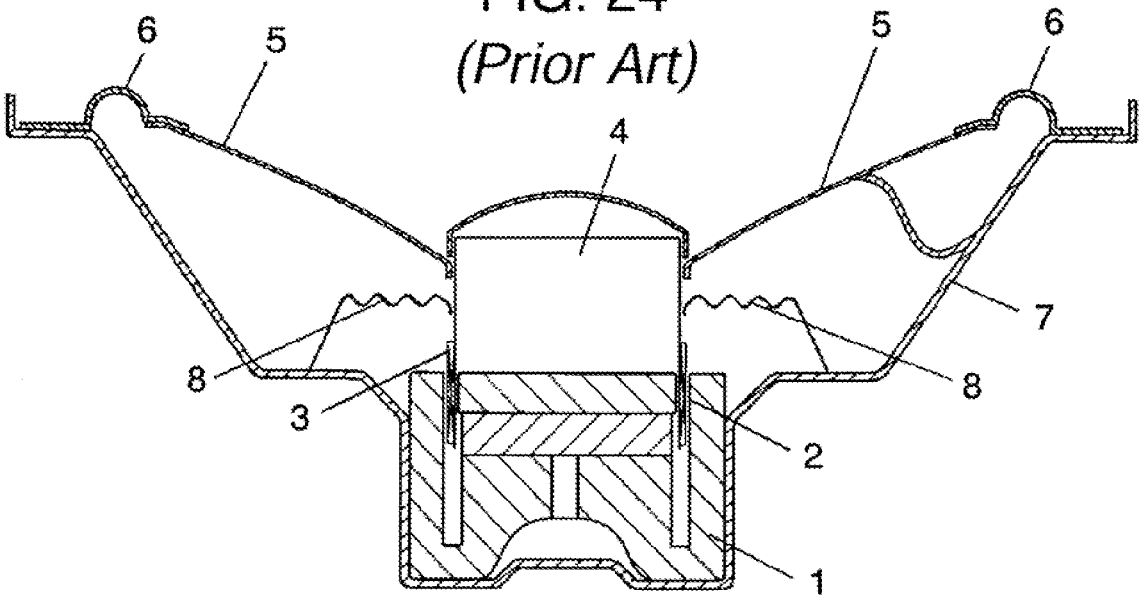
FIG. 24 (Prior Art)
FIG. 24 is a sectional view of a conventional speaker.
Figure 25:
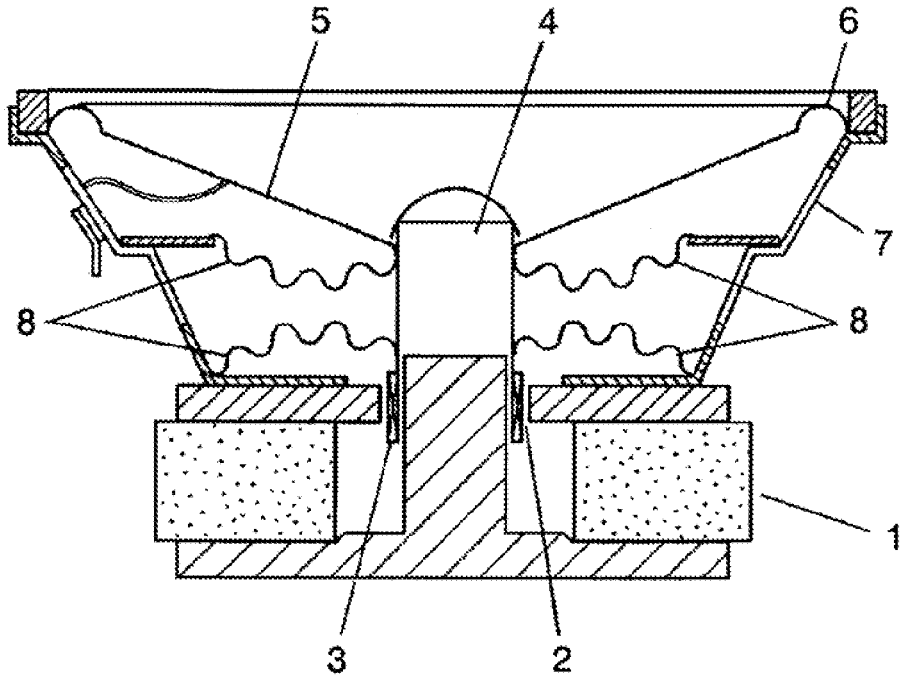
FIG. 25 (Prior Art)
FIG. 25 is a sectional view of a conventional speaker.
Figure 26:
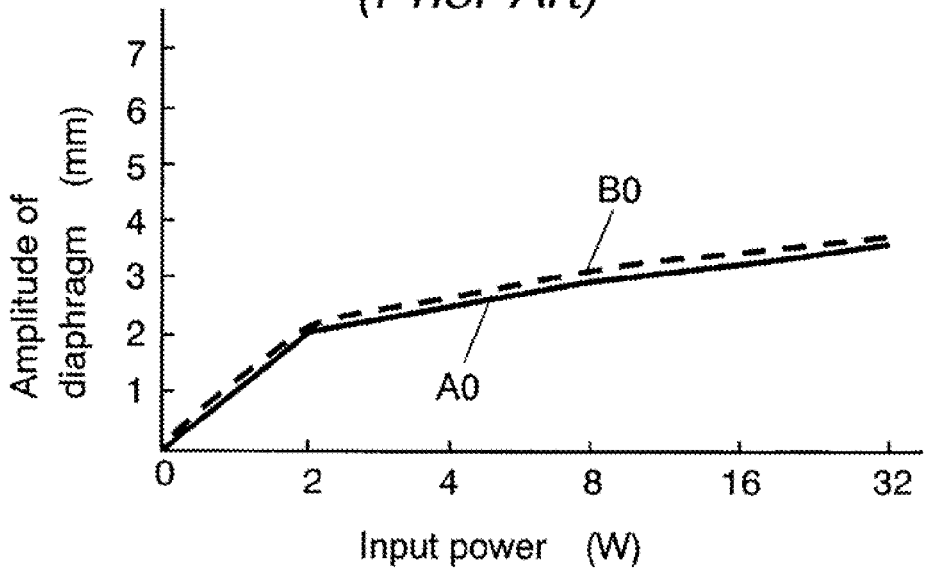
FIG. 26 (Prior Art)
FIG. 26 is a characteristic diagram showing power linearity of the conventional speaker.
Figure 27:
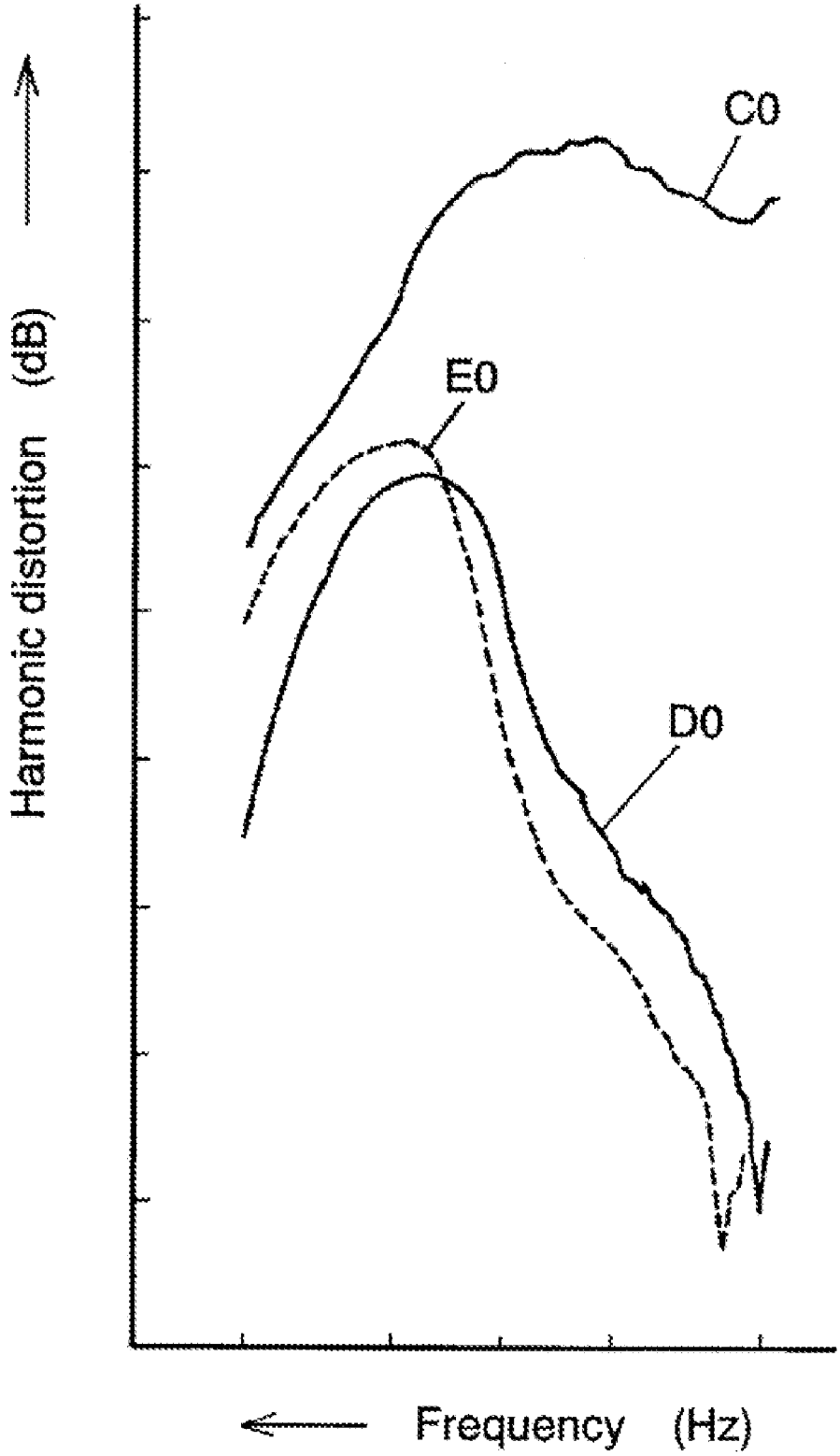
FIG. 27 (Prior Art)
FIG. 27 is a characteristic diagram showing a harmonic distortion characteristic of the conventional speaker.

(Exemplary embodiment 16) A speaker in accordance with exemplary embodiment 16 of the present invention is described with reference to FIG. 23. The basic configuration of the speaker is similar to that of the speaker of embodiment 15 of the present invention. FIG. 23 is a front view of dust cap 231.

In the speaker of embodiment 16, as shown in FIG. 23, rib 242 is disposed in coupling section 241 between dust cap 231 and diaphragm 16. This configuration can increase rigidity of the coupling section of dust cap 231 to diaphragm 16 and voice coil body 14, so that a driving force of voice coil body 14 can be precisely transmitted to diaphragm 16. As a result, distortion can be reduced.

INDUSTRIAL APPLICABILITY

A diaphragm and a suspension holder are coupled to each other at a bent section, and a suspension is formed of a first edge and a second edge. A damper causing the nonlinearity and asymmetry can be omitted, and the second edge can cancel the asymmetry of the first edge, so that the nonlinearity and asymmetry as the suspension can be essentially solved, the harmonic distortion of the speaker can be reduced, the power linearity can be improved, and the performance of the speaker can be improved. A part from the bent section to the inner periphery of the diaphragm is supported by the suspension holder. Therefore, securing the rigidity does not require a conical shape of the diaphragm, but even a flat diaphragm can be sufficiently rigid. Downsizing and low profile of the speaker can be realized.

The invention claimed is:

1. A speaker comprising:

a magnetic circuit having a magnetic gap, a top surface, and a bottom surface;

a voice coil body having a bobbin and a coil section, the coil section being movable in the magnetic gap;

a diaphragm having a front surface and a back surface, with an inner periphery of the diaphragm coupled to the voice coil body;

a frame supporting the diaphragm and the magnetic circuit;

a first edge coupling an outer periphery of the diaphragm to the frame;

a suspension holder; and a second edge coupling an outer periphery of the suspension holder to the frame, wherein an inner periphery of the suspension holder is coupled to the voice coil body between the back surface of the diaphragm and the top surface of the magnetic circuit, wherein the diaphragm has a bent section between the outer periphery of the diaphragm and the inner periphery of the diaphragm, wherein part of the diaphragm extending from the bent section to the outer periphery of the diaphragm is conical, and wherein the diaphragm is coupled to the suspension holder at the bent section.

2. A speaker according to claim 1, wherein part of the diaphragm extending from the inner periphery of the diaphragm to the bent section has a plane shape, a conical shape, or an inverted conical shape.

3. A speaker according to claim 1, wherein the bent section is located closer to the outer periphery of the diaphragm than the inner periphery of the diaphragm.

4. A speaker according to claim 1, wherein the diaphragm has a higher density on an outer peripheral side of the bent section than on an inner peripheral side of the bent section.

5. A speaker according to claim 1, wherein the bobbin and the suspension holder are made of metal material.

6. A speaker according to claim 1, wherein the suspension holder is made of pulp.

7. A speaker according to claim 1, wherein the first edge and the second edge are made of urethane.

8. A speaker according to claim 1, wherein the first edge has a portion that protrudes outwardly in a first direction from the front surface of the diaphragm and the second edge has a portion that protrudes in a second direction, opposite to the first direction.

9. A speaker according to claim 1, wherein the first edge has a portion that protrudes inwardly in a first direction from the back surface of the diaphragm and the second edge has a portion that protrudes in a second direction, opposite to the first direction.

10. A speaker according to claim 1, wherein the first edge and the second edge have substantially similar elastic modulus.

11. A speaker according to claim 1, wherein the second edge is coupled to the frame between the top surface and the bottom surface of the magnetic circuit.

12. A speaker according to claim 1, further comprising a dustproof net, with an inner periphery of the dustproof net coupled to the voice coil body between the suspension holder and the top surface of the magnetic circuit.

13. A speaker according to claim 1, further comprising a dustproof net, wherein the frame surrounds the magnetic circuit and has a ventilation hole in a surface facing the bottom surface of the magnetic circuit, and the dustproof net covers the ventilation hole.

14. A speaker according to claim 1, wherein the suspension holder has at least one opening in one of a top surface of the suspension holder or a side surface of the suspension holder.

15. A speaker according to claim 1, wherein a top surface of the suspension holder is a corrugation surface.

16. A speaker according to claim 1, wherein the frame has an opening between where the first edge and the second edge are coupled to the frame.

17. A speaker according to claim 1, further comprising an elastic body, wherein the diaphragm is coupled to the suspension holder via the elastic body.

18. A speaker according to claim 17, wherein the elastic body is a silicon-based adhesive.

19. A speaker according to claim 1, wherein part of the suspension holder extending from the bent section of the diaphragm toward the outer periphery of the suspension holder has a higher density than part of the suspension holder extending from the bent section of the diaphragm toward the inner periphery of the suspension holder.

20. A speaker according to claim 1, wherein part of the suspension holder extending from the bent section of the diaphragm toward the outer periphery of the suspension holder is curved.

21. A speaker according to claim 1, wherein the outer periphery of the suspension holder has an L-shaped cross section having a plane section and an erect section, and the second edge is coupled to the plane section.

22. A speaker according to claim 1, wherein the outer periphery of the suspension holder has an L-shaped cross section, having a plane section and an erect section, and the second edge is coupled to both the plane section and the erect section.

23. A speaker according to claim 1, wherein the second edge has an upper edge section and a lower edge section, and the upper edge section and the lower edge section grapple the outer periphery of the suspension holder.

24. A speaker according to claim 1, wherein the suspension holder is L-shaped in cross section, and the suspension holder has a folded section at a tip of the outer periphery of the suspension holder.

25. A speaker according to claim 1, wherein the diaphragm has a folded section at a tip of the outer periphery of the diaphragm.

26. A speaker according to claim 1, further comprising a dust cap, wherein the dust cap is coupled to the voice coil body and the diaphragm.

27. A speaker according to claim 26, wherein the dust cap has a rib, and the rib is coupled to the diaphragm.

* * * * *